US005084985A

United States Patent [19]

Ventola

[11] Patent Number: 5,084,985

[45] Date of Patent: Feb. 4, 1992

[54] DRYING SECTION IN A PAPER OR BOARD MACHINE AND METHOD FOR GUIDING A WEB THEREIN

[75] Inventor: Jouko Ventola, Inkeroinen, Finland

[73] Assignee: Oy Tampella Ab, Tampere, Finland

[21] Appl. No.: 299,501

[22] Filed: Jan. 23, 1989

[30] Foreign Application Priority Data

Jan. 22, 1988 [FI] Finland ..... 880277

[51] Int. Cl.[5] ..... F26B 5/00

[52] U.S. Cl. ..... 34/115; 34/114; 34/123; 162/370

[58] Field of Search ..... 34/114, 113, 115, 116, 34/117, 120, 123; 162/370, DIG. 7, 193

[56] References Cited

U.S. PATENT DOCUMENTS

| | | | |
|---|---|---|---|
| 1,949,237 | 2/1934 | Bradner | 34/115 |
| 3,430,352 | 3/1969 | Fleissner | 34/115 |
| 3,868,780 | 3/1975 | Soininen et al. | 34/117 |
| 4,441,263 | 4/1984 | Vedenpaa | 34/115 |
| 4,483,083 | 11/1984 | Chance | 34/113 |
| 4,882,854 | 11/1989 | Wedel et al. | 34/117 |

FOREIGN PATENT DOCUMENTS

| | | |
|---|---|---|
| 72162 | 12/1986 | Finland . |
| 72547 | 2/1987 | Finland . |

*Primary Examiner*—Albert J. Makay
*Assistant Examiner*—John Sollecito
*Attorney, Agent, or Firm*—Pollock, Vande Sande & Priddy

[57] ABSTRACT

In the drying section of a paper or board machine, a web travels in a meander-like fashion around drying cylinders and it is provided with ducts for delivering web-run stabilizing suction into the drying section. At least one cylinder is provided with ducts for delivering suction in the interior of a drying cylinder, the jacket of the cylinder being provided with flow paths communicating with the duct for delivering suction outside the cylinder both in a sector in which web runs around the jacket of the cylinder and in a sector in which the jacket of the cylinder is unoccupied by the run of the web.

14 Claims, 5 Drawing Sheets

DRYING SECTION IN A PAPER OR BOARD MACHINE AND METHOD FOR GUIDING A WEB THEREIN

FIELD OF THE INVENTION

The present invention relates to a method for guiding a web in the drying section of a paper or board machine. The invention relates also to a structure of a drying section in a paper or board machine.

The invention applies particularly to the upstream part of a drying section, e.g. for example the first group of drying cylinders, wherein a web to be dried travels supported all the time by a backing wire or a corresponding continuous backing fabric in a meander-like fashion around the cylinders, so-called upper cylinders and lower cylinders, included in two different rows of cylinders. However, the invention can be applied also elsewhere in a drying section wherever the stable running of a web is desired.

BACKGROUND OF THE INVENTION

It is generally known that in a paper machine the backing fabrics, the cylinders of a drying section and a paper web to be dried carry along a lot of air. This creates positive or negative pressures at the junctions between backing fabrics, cylinders and web. This results in the unstable running of a web, e.g. for example, a web to be dried tends to rise off a backing fabric causing twisting, flapping etc., and the like of the edge of a paper web, which is a major problem especially at high running speeds resulting in the tearing hazard of a paper web. This problem appears both during normal operation and during the lead-in of the paper web.

Patent literature discloses a plurality of solutions for overcoming the above problems. The main object in these solutions is to effect the control of pressures prevailing at the points of engagement and disengagement between cylinders and webs running thereover as well as backing fabrics by means of various air control boxes which are complicated in construction. This type of boxes have been described e.g., for example, in U.S. Pat. No. 4,441,263 and in Finnish Patent 72547.

For stabilizing the running of a web on the cylinder jacket itself it has been proposed that the cylinder be provided with suction which is restricted to a certain suction zone only, i.e. that is to that sector in which the web travels along the jacket of a cylinder. Such arrangement has been disclosed e.g., for example, in Finnish Publication 72162. In this case, suction has no effect on the behaviour of a web upstream of the cylinder jacket.

U.S. Pat. No. 3,868,780 discloses a drying section in a paper machine, wherein the part of a cylinder group facing the backing wire of a web to be dried is designed as a closed space which is in communication with this suction. This closed space is quite large and such arrangement is not capable of sufficiently controlling the pressure at various points with suction effected being distributed rather non-uniformly over the area of a group of cylinders.

SUMMARY OF THE INVENTION

An object of the present invention is to eliminate the above drawbacks. In order to achieve this, a method of the invention provides for arranging to act from inside the cylinder of a drying section on the outside of the cylinder both in the sector wherein a web travels around the cylinder jacket and in the sector wherein the cylinder jacket is unoccupied by a running web. This structurally simple solution provides a controlled run for the web both on the cylinder surface and over those distances which the web travels from a drying cylinder preceding this cylinder to the cylinder with suction and over those distances which the web proceeds on to a drying cylinder following this cylinder. In a drier group, the above-mentioned three cylinders generally build, in the common run of a web and a wire, a more or less steep pocket and the effect of suction arranged inside the cylinder is primarily directed within the area of this pocket.

A similar improvement to the above drawbacks is achieved by means of the drying section of a paper or board machine, wherein the above-mentioned cylinder has been provided with a duct for passing suction inside the cylinder and the cylinder jacket is provided with flow paths which are in communication with the duct for passing suction outside the cylinder. By means of the cylinder, suction is passed outside the cylinder both in the sector in which a web travels around the cylinder jacket and in the sector in which the cylinder jacket is unoccupied by a running web.

The invention includes several preferred embodiments of a drying section. The above cylinder is preferably a guide cylinder in a group of cylinders used in the forward part of a single-wire drive positioned in the web traveling direction between the actual steam-heated drying cylinders and whereat the backing wire is against the cylinder jacket with the web on the outside of the backing wire.

There are also several possibilities of utilizing a suction generated through a sector aligned with the part of a cylinder unoccupied by a running web. It is possible to form here a closed space whereby a stable web run can be effected on over the longest possible distance between the cylinders. Since three successive cylinders in a drier group, e.g., for example two upper cylinders (drying cylinder) for a single-wire drive in the forward section and a lower cylinder (supporting cylinder) therebetween always build a certain type of pocket in the run of a web, the space can be formed within this pocket by simple arrangements.

Structurally, a drying section of the present invention can be readily designed since the cylinder, into which suction is passed, only needs to be provided with a duct whose one end can be connected to a suction system and whose other end can be communicated with the inside of the cylinder through the cylinder gable. The cylinder can be structurally a very simple, hollow cylinder whose jacket is provided with flow paths, such as holes or the like, for delivering suction from inside therethrough to the outside of cylinder jacket.

The present invention will now be described in more detail with reference made to the accompanying drawings, in which

DETAILED DESCRIPTION OF THE PREFERRED EMBODIMENT

Figure 1:
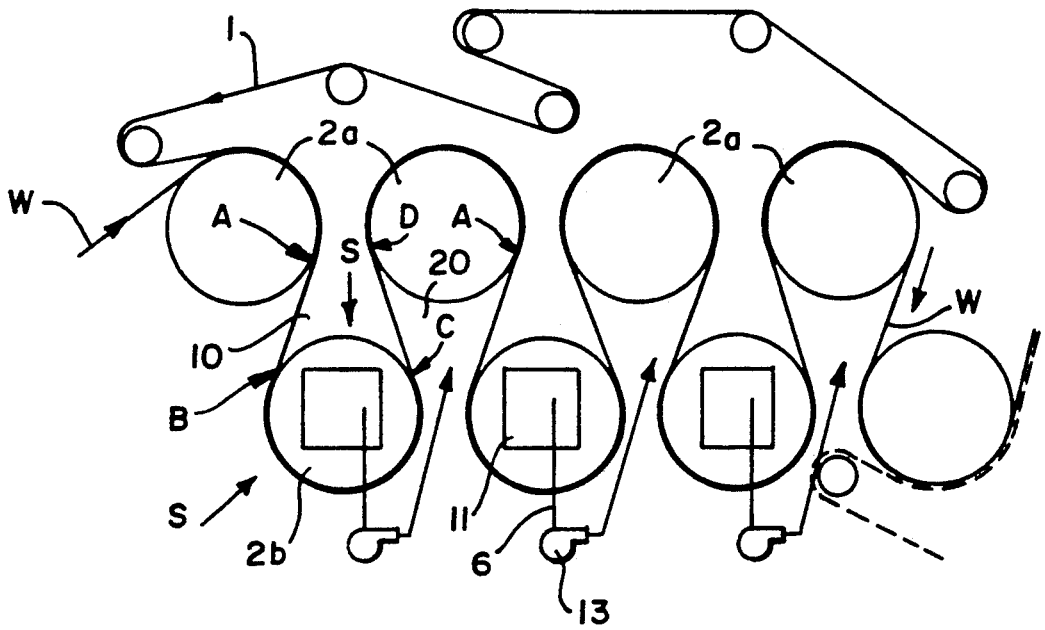
FIG. 1 is a side view of a drying section of the present invention.

FIG. 1 illustrates a first drier group in the drying section of a paper or board machine, wherein a still relatively moist web is advanced in a supported fashion by a single-wire drive whereby a web W is continuously supported during its run from one cylinder to another by a backing wire or some other continuous backing belt indicated in the figure by reference numeral 1. The cylinders in this drier group make up two rows, an upper row of cylinders and a lower row of cylinders. Backing wire 1 and web W travel together in a meander-like fashion so that they alternately pass over upper cylinders 2a and lower cylinders 2b in a certain sector. The upper cylinders 2a are suppled with steam or some other heat transfer medium whereby the drying of web W is effected with the web positioned at upper cylinders 2a against the cylinder jacket while backing wire 1 is traveling below this point. On the other hand, at unheated lower cylinders 2b the backing wire 1 is positioned against the cylinder jacket with web W running on the outside. The operation of the lower cylinders 2b will be described in more detail hereinbelow.

As it starts from upper cylinder 2a toward lower cylinder 2b the web has a tendency to stick to the cylinder surface at point A and thus tends to disengage from backing wire 1 which is on the outside at this point. On the other hand, at point B the backing wire 1 has a tendency of pumping air between the backing wire and web W. As a result of this, there is instability in the running of web W and it is very common for example that, if no effort is made to stabilize the web, it will travel around lower cylinder 2b at a distance of a few millimeters from the surface of backing wire 1. After traveling around the jacket of cylinder 2b within a sector $\alpha$, the wire and the web pull away from the cylinder jacket at point C and arrive after a free section at the jacket of a following upper cylinder 2a at point D where the web may wrinkle if it is still detached from wire 1.

According to the invention, the lower cylinders 2b of a drier group are connected to suction through the intermediary of pipes 6 fixed to the gables thereof. This is how vacuum is created in the interiors 7 of lower cylinders 2b. The interior of lower cylinders 2b is hollow for the main part and their jacket 3 is provided with holes 4 which are evenly distributed over the entire periphery of a cylinder, penetrate through the jacket and are in communication with interior 7. The structure of cylinders 2b is illustrated in more detail in FIGS. 2 and 3. The interior of lower cylinders 2b does not include any restriction means which would deliver suction outside the cylinder jacket 3 only in a given sector. Thus, the vacuum prevailing in cylinder interior 7 acts uniformly over the entire periphery of a cylinder whereby it works both in sector $\alpha$, in which web W as well as backing wire 1 travel around cylinder jacket 3, and in sector $\beta$, in which the cylinder jacket is unoccupied by the running of web and backing wire. Thus, all over on the outside of jacket 3 of cylinder 2b there is formed suction indicated in FIGS. 1 and 2 by arrows S.

The suction directed from outside the jacket 3 of lower cylinders 2b towards the jacket 3 has advantageous effects both in sector $\alpha$ and in sector $\beta$. Within sector $\alpha$ the suction S maintains web W well on the surface of backing wire 1 and thus the running of a web is stable at this point. Within sector $\beta$ the suction mostly acts inside a pocket formed by web and backing wire as they travel from a cylinder 2a of the first row of cylinders to a cylinder 2b of the second row of cylinders, whereat the web turns around and is again deflected in the opposite direction to a cylinder 2a of the first row of cylinders. This pocket is designated in FIG. 1 by reference numeral 10 and in the direction perpendicular to the axes of rotation of the cylinders it is confined on either side by the runs of web W and backing wire 1 between the cylinders. The suction prevailing in pocket 10 has the effect that web W, which at this pocket runs on the outside, is well pressed against backing wire 1 with suction S acting on the web through the backing wire and the running of a web is stable also in this section. Thus, for example, at the points shown in FIG. 1 with characters A and B there will be no such problems as mentioned earlier. Thus, with a structurally quite simple cylinder 2b it is possible to achieve a stable web run both upstream of cylinder, at cylinder and downstream of cylinder by using very simple arrangements that can be established by connecting lower cylinders 2b to a suitable suction system.

Figure 3:
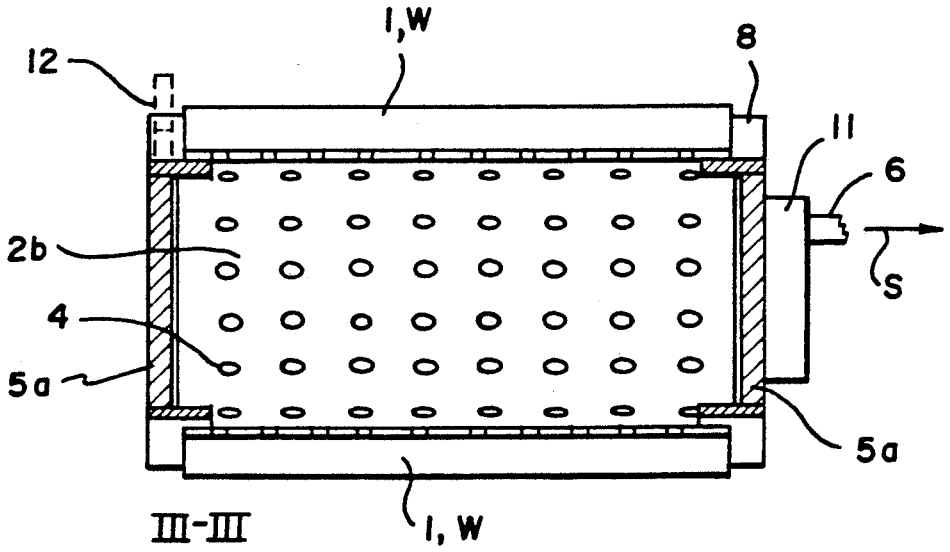
FIG. 3 is a plan view of the embodiment of FIG. 2 in a section taken along a line III—III in FIG. 2 in the direction of the axes of rotation of the cylinder.

FIGS. 1 and 3 illustrate how lower cylinders 2b can be connected to suction. Either one or both ends of cylinders 2b are provided with boxes 11, through which the end of a cylinder axle can be passed with a sufficient tightness and which are in communication with cylinder interior 7 through openings in the gable of a cylinder. From box 11 can be extended a duct, such as a pipe 6, to a source of suction (arrow S) which can be, for example, a conventional fan. The box can be sufficiently sealed and the effect of a flow occurring between the box and the gable of a cylinder is negligible. FIG. 1 shows how the air sucked from cylinder 2b can be passed by way of a fan 13 inside a pocket 20 which, as seen from pocket 10, lies on the other side of web W and backing wire 1 at a sector of the upper cylinder jacket unoccupied by the web for ventilating the pocket by conventional techniques.

Figure 4:
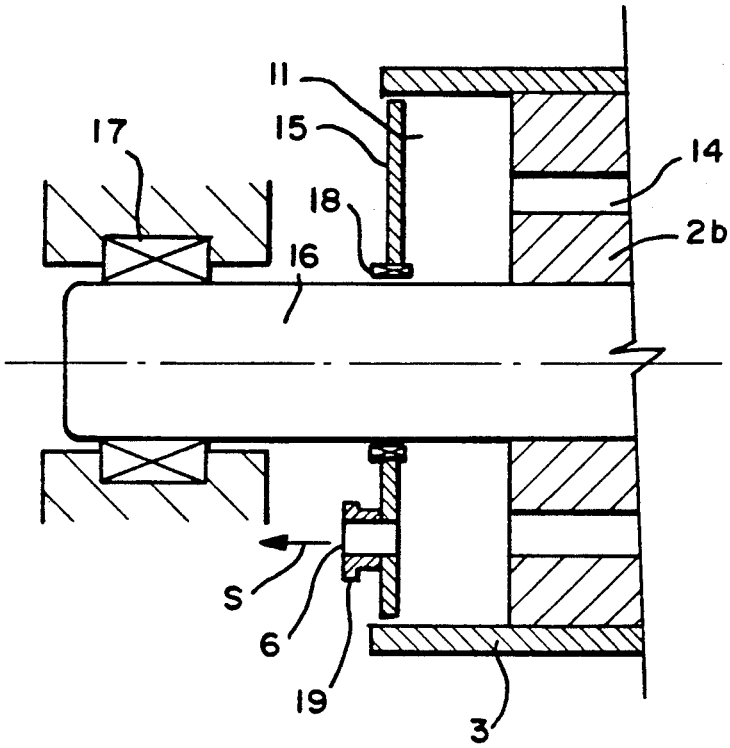
FIG. 4 is a sectional view in the direction of the diameter of the cylinder showing a possibility of supplying suction in the cylinder through one of its gables.
Figure 5:
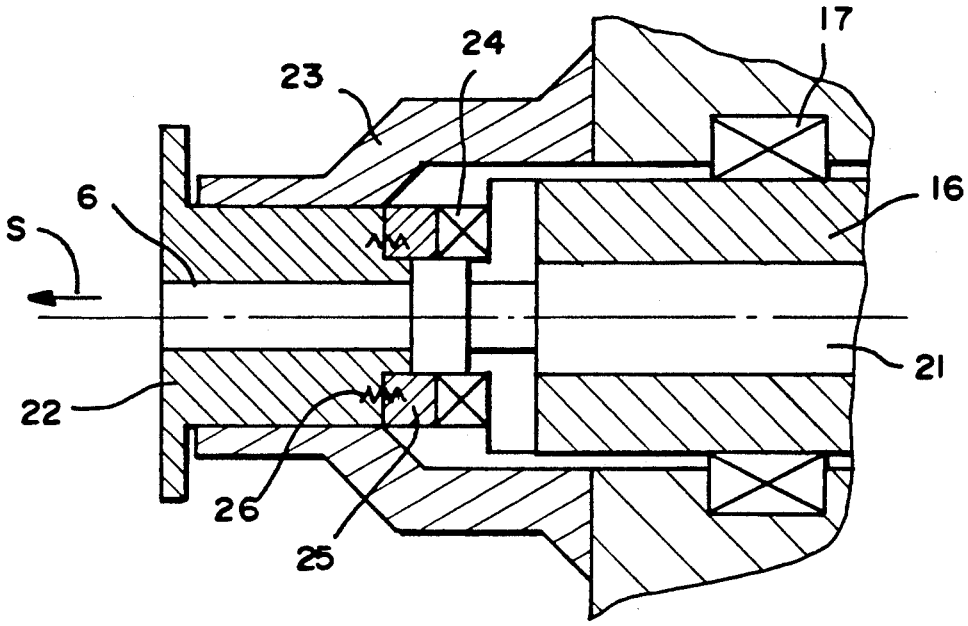
FIG. 5 is a view similar to FIG. 4 showing another possibility of supplying suction in the cylinder through one of its gables.

FIGS. 4 and 5 illustrate other alternatives for supplying suction inside a cylinder 2b. In FIG. 4, the gable of the cylinder is inside a jacket 3 provided with a recess 11 which in principle corresponds to a box 11 shown in FIG. 3. From the recess towards the interior of the cylinder extend openings 14 which in communication through the hollow interior of the cylinder with holes 4 in the cylinder jacket. Towards the exterior the recess is confined by a plate 15 fastened to the support structures and provided with a bearing system 18 for passing a cylinder axle 16 through to a bearing support 17. The plate 15 is provided with a fitting 19 for connecting space 11 to suction S. FIG. 5 illustrates an alternative for supplying suction inside the cylinder through the end of the axle 16, said axle being provided with an axial cavity 21 which is in communication with the interior of the cylinder and thereby with holes 4. The end of this axle is in abutment with an axial bearing 24 on the other side of which to an axle-supporting body 23 is fastened a fitting 22, whose end is provided with an annular member 25 which is adapted to be urged by means of a spring 26 against bearing 24 for sealing the abutment joint between the axle end and the fitting. The fitting 22 can be connected to suction which is transmitted through an opening in the axle gable inside the axle. Naturally, there are still other ways of supplying suction through the gable of a cylinder inside the cylinder.

Lower cylinders 2b can be each connected to one and the same fan or they can be provided with a multi-fan system whereby, as shown in FIG. 1, they are each connected to their own fan 13 for a more reliable operation and for easire adjustment of the suction to provide a desired effect for each lower cylinder 2b.

Figure 2:
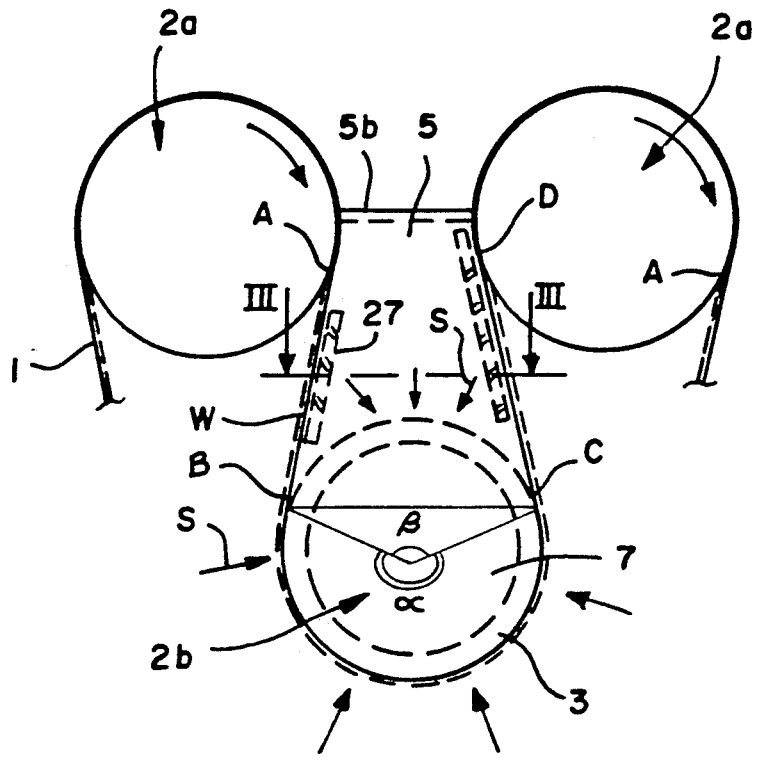
FIG. 2 shows one preferred embodiment of a drying section of the present invention.

FIGS. 2 and 3 illustrate one embodiment of the invention wherein the suction prevailing in a space above the sector $\beta$ of lower cylinder 2b unoccupied by the run of a wire and a web, such as in a pocket designated with numeral 10 in FIG. 1, has been intensified by forming there a closed space 5. Space 5 is essentially sealed from ambient air in a manner that, in perpendicular to the axis of rotation of the cylinder, it is confined below by jacket 3 of lower cylinder 2b in sector $\beta$, in the longitudinal direction of a drying section, in the main traveling direction of a web, it is confined by a free run of wire 1 and web W arriving in one direction at cylinder 2b and a free run of wire 1 and web W starting in the opposite direction from cylinder 2b. In the direction of the axes of rotation of cylinders, this space is closed by means of side walls 5a which, at the gables of cylinder 2b, extend substantially parallel to the plane of rotation of the cylinder and the edges of wire 1. Side walls 5a can be fastened, for example, to the supporting frame of cylinders 2a and 2b in a drying section. The inner surface of side walls 5a lies outside the plane of the edge of backing wire 1 and at the plane of wire 1 towards space 5 from inner surface extends a sealing strip 8 for sealing the space 5 at the outer edges of wire 1. In the longitudinal direction of a drying section, said side walls 5a may terminate exactly at the edges of sealing strips 8 and the wire but, naturally, they can also be made wider by extending them as shown with dash-and-dot lines in FIG. 3.

It is preferable to have the closed space 5 extend at upper cylinders 2a to such a level that it is limited at least to point A whereat web W and wire 1 disengage from the jacket of cylinder 2a preceding lower cylinder 2b and the area, which defines it in the longitudinal direction of a drying section in the opposite direction, includes point D whereat web W and wire 1 reach the jacket of upper cylinder 2a following lower cylinder 2b. The area limiting space 5 in the direction perpendicular to the axes of rotation may thus cover the entire run of web W and wire 1 arriving at and departing from lower cylinder 2b within the zone they travel freely from upper cylinder 2a to lower cylinder 2b and similarly from lower cylinder 2b to the next upper cylinder 2a. On the still open side of a pocket 10 formed by upper cylinders 2a and a lower cylinder 2b therebetween, the space 5 is closed by means of a top wall 5b which can be fastened, for example, to the upper edges of side walls 5a. Top wall 5b is mounted between upper cylinders 2a at the location where the jackets of upper cylinders are closest to each other. Moreover the closed space 5 can possibly be fitted with means for deflecting suction to critical disengagement/engagement points A, B, C and D on the run of wire 1 and web W, especially to the problematic point A whereat the wire and the web disengage from the jacket of upper cylinder 2a which would thus reduce the effect of suction in zones A-B and C-D on the free run of web and wire.

FIG. 2 illustrates one possibility of guiding suction in space 5 to point A. Here, to side walls 5a of the space is fastened a perforated plate 27 which covers the free run of wire 1 and web W upstream of cylinder 2b, whereby suction is applied thereto through perforations in the plate. The perforated plate does not reach point A which thus receives more effective suction. Similarly, the point B below the bottom end of perforated plate, at which point the web and the wire join the jacket of a lower cylinder, is beyond the suction-limiting action of the perforated plate. On the opposite side of space 5 within zone C-D is also fitted a similar plate 27 which has no effect on point C but extends up to point D since this point, whereat the wire and the web arrive at the jacket of an upper cylinder, is not as poblematic as the other points. It is quite possible to leave point D completely outside the space 5 by setting top wall 5b in a sufficiently inclined position.

In effect, the formation of closed space 5 requires side walls 5a as well as top wall 5b, whereby the assembly remains open in the direction perpendicular to the axes of rotation of cylinders within the free runs of web W and wire 1 and over these sections the space 5 is actually closed by virtue of wire 1 and web W. The air flow effected by suction S from ambient air occurs then mainly therethrough since backing wire 1 and web W are permeable to air. This air flow effects also urging of web W against backing wire 1.

FIG. 6 illustrates alternative structures for a lower cylinder 2b used in the invention. The cylindrical jacket 3 of cylinder 2a is provided with through-going bores 4 whose diameter can be 1–10 mm and these bores are evenly distributed over the periphery of cylinders, whereby the spacing therebetwwen can be 2–25 cm. The surface of cylinders shown in the figure is smooth but such bores can also be made in known grooved cylinders in which the grooves extend in the peripheral direction of cylinders, such as in the traveling direction of a web.

Figure 6A:
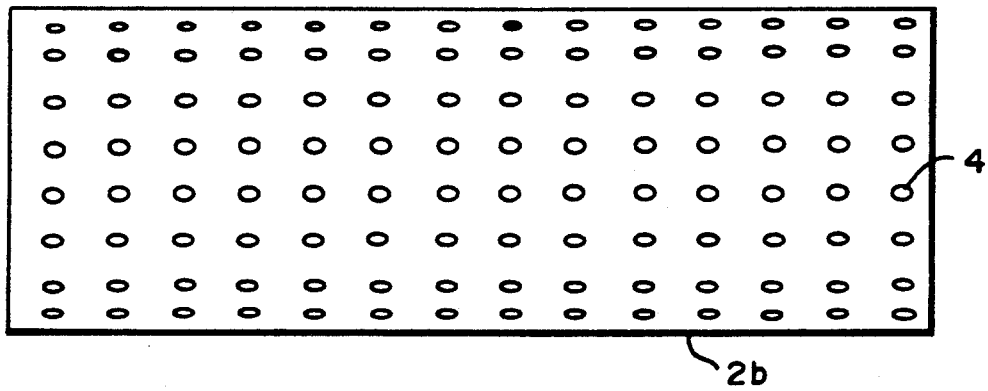
FIGS. 6a–6c shows three different embodiments of a cylinder that can be used in a drying section of the invention.
Figure 6B:
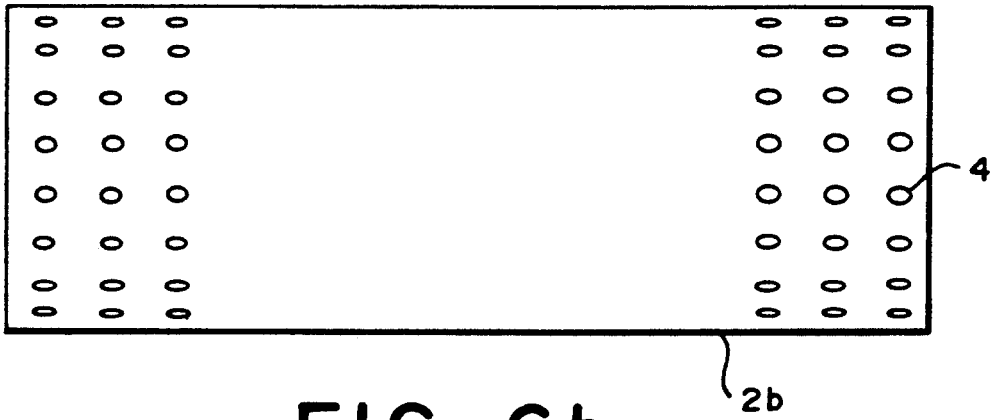
Figure 6C:
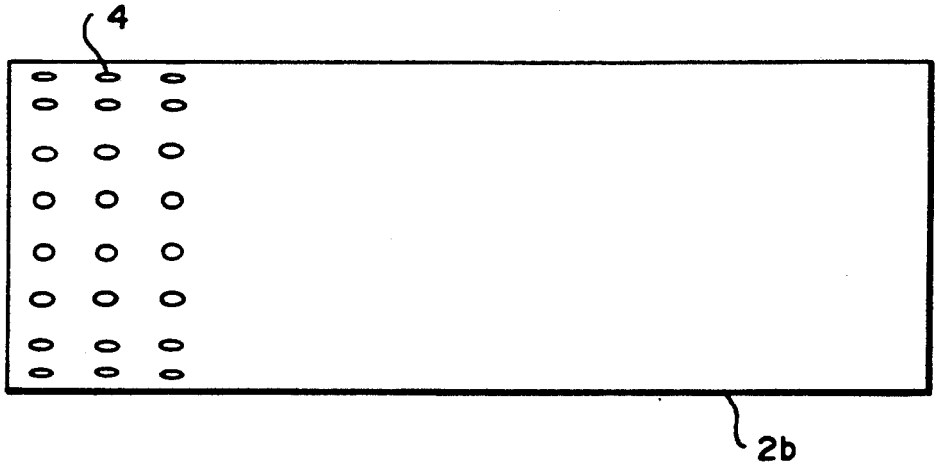

In FIG. 6a, bores 4 cover the entire width of a cylinder while in FIG. 6b, only the zones restricted to the gables of cylinder 2b are provided with bores and the central portion is smooth, the zone at each end of the cylinder having a width of about 1 m. The jacket of the cylinder over its entire width can also be provided with grooves extending in the traveling direction of a web even within the zone of bores. By means of a cylinder shown in FIG. 6b, the effect stabilizing the run of a web can created especially in the trouble-sensitive marginal zones of a web. FIG. 6c shows a solution, wherein only a zone restricted to one of the gables is provided with bores over an area having a width of about 1 meter. Otherwise the cylinder can be smooth or provided with grooves over the entire width thereof. This type of cylinder is intended for a situation in which the invention is only used in a lead-in operation.

Figure 7:
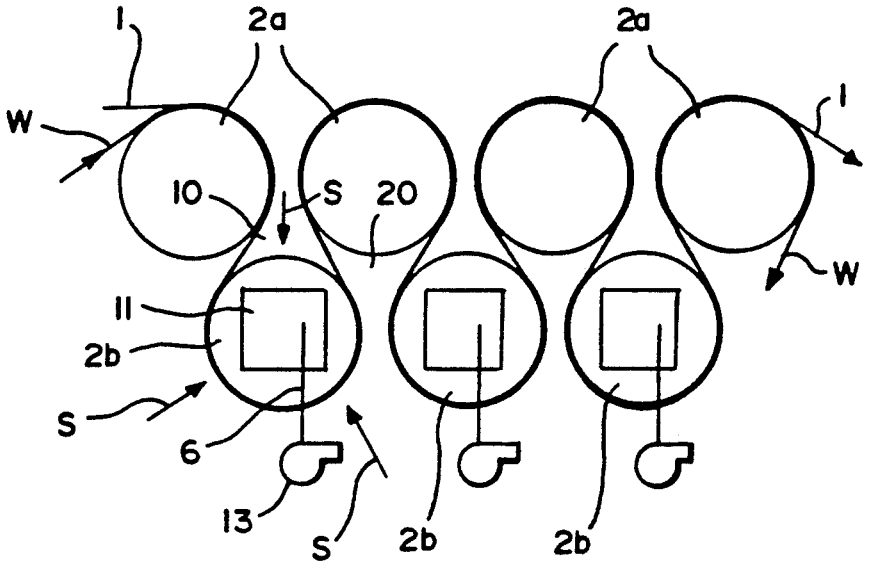
FIG. 7 is a side view of one drying section assembly obtainable by means of the present invention.

The present invention provides a substantial improvement for running a web through a drying section and, by virtue of improved stability, it is possible to reach higher machine operating speeds. Also the structures included in a drying section can be considerably simplified. In addition, the invention offers a possibilty of designing totally novel drying section assemblies, wherein cylinders included in the same row can be brought quite close to each other and, since bulky blow boxes are not needed, the free web runs between cylinders can also be reduced in length whereby the upper and lower cylinders can also be brought closer in vertical direction. Thus, machine lengths can be substantially reduced while still maintaining the same drying effect. FIG. 7 illustrates such a construction with the same reference numerals as in FIG. 1. The invention also facilitates the use of a single-wire drive with heavier paper/board grades. The invention also facilitates the use of more open backing wires for increased drying capacity.

The invention is not limited to just the above embodiments but can be varied and modified with the scope an inventive idea set forth in the claims. In the drawings, upper cylinders *2a* and lower cylinders *2b* are equal as to their diameters but it is also possible to design an assembly, wherein lower cylinders *2b* provided with suction according to the invention are smaller in diameter than upper cylinders *2a* serving as actual drying cylinders. Neither is the application of this invention restricted to the forward portion of a drying section with the lead-in of a web effected by a single-wire drive but, if necessary, it can also be applied to some of the cylinders in the downstream end of a drying section, whereat the lead-in of a web to be dried is effected by means of two backing wires.

I claim:

1. A drying section in a paper or board machine, wherein a web travels in a meander-like fashion around drying cylinders and which is provided with suction ducts for delivering web run stabilizing suction into the drying section, said drying section including a space formed at at least one of the cylinders by a meander-like travelling of said web, said space being confined in a direction perpendicular to the axis of rotation of the cylinders by the run of the web unsupported by a cylinder jacket and arriving at a cylinder, by the jacket of said cylinder unoccupied by the run of the web, and by the run of the web unsupported by said cylinder jacket and departing from said cylinder, said cylinder including a hollow interior communicating with a suction means for delivering suction into the interior of said cylinder, connected to said suction duct at the cylinder gable, and a jacket surrounding said interior, said jacket being provided with flow paths in the direction of the axis of rotation of said cylinder along the entire length of said jacket, said flow paths delivering said said cylinder both in a sector in which the web runs around said jacket of said cylinder and in a sector in which said jacket of said cylinder is unoccupied by the run of the web.

2. A drying section as claimed in claim 1, wherein said web is supported by a backing member and travels alternately around cylinders included in two different rows of cylinders whereby, at a cylinder included in the first row of cylinders, said web lies against the jacket of the cylinder while said backing member is on the outside and, at a cylinder included in the second row of cylinders, said web is on the outside while said backing member lies against the jacket of the cylinder, said suction means for delivering suction into the interior of said cylinder being connected to at least one of the cylinders included in said second row of cylinders.

3. A drying section as claimed in claim 1, wherein said space confined by said runs of the web and said jacket of said cylinder, and being in alignment with the sector in which said jacket of said cylinder is unoccupied by the run of the web, is substantially sealed from ambient air in a direction parallel to the axis of rotation of said cylinder by walls mounted adjacent to and extending parallel to the edges of the web.

4. A drying section as claimed in claim 3, wherein said substantially sealed space is limited in a direction perpendicular to the axis of rotation of said cylinder to a point whereat said web disengages from the jacket of a cylinder preceding said cylinder.

5. A drying section as claimed in claim 4, wherein said substantially sealed space is limited in the longitudinal direction of the drying section by the run of the web arriving at said cylinder along the entire zone through which the web runs freely from a cylinder preceding said cylinder to said cylinder.

6. A drying section as claimed in claim 4, wherein said substantially sealed space is limited in the longitudinal direction of the drying section by the run of the web departing from said cylinder along the entire zone through which the web runs freely from said cylinder to a next cylinder following said cylinder.

7. A drying section as claimed in claim 5, wherein said substantially sealed space is also limited in the longitudinal direction of the drying section by the run of the web departing from said cylinder along the entire zone through which the web runs freely from said cylinder to a next cylinder following said cylinder.

8. A drying section as claimed in claim 3, wherein said substantially sealed space is entirely locate inside a pocket which is formed by said cylinder, and said runs of the web between said cylinder and a preceding cylinder as well as between said cylinder and a following cylinder, said substantially sealed space being confined in a direction perpendicular to the axes of rotation of cylinders on the open side of said pocket opposite to said cylinder by a wall which is mounted between said preceding cylinder and said following cylinder.

9. A drying section as claimed in claim 2, wherein said duct is led by way of a suction producing means to extend to a pocket situated at a web-run-free sector of a cylinder included in said first row of cylinders.

10. A drying section in a paper or board machine, wherein a web travels in a meander-like fashion around drying cylinders and which is provided with suction ducts for delivering web run stabilizing suction into the drying section, said drying section including a substantially sealed space formed at at least one of the cylinders by a meander-like travelling of said web, said space being confined in a direction perpendicular to the axis of rotation of said cylinder by the run of the web unsupported by a cylinder jacket and arriving at said cylinder, by the jacket of said cylinder unoccupied by the run of the web, and by the run of the web unsupported by said cylinder jacket and departing from said cylinder, and in the direction parallel to the axis of rotation of said cylinder by a wall mounted adjacent to and extending parallel to the edges of the web, said cylinder including a hollow interior communicating with a suction means for delivering suction into the interior of said cylinder and connected to said suction duct, and a jacket surrounding said hollow interior, said jacket being provided with flow paths extending in the direction of the axis of rotation of said cylinder, said flow paths being in flow communication with said cylinder both in a sector in which the web runs around said jacket of said cylinder and in a sector in which said jacket of said cylinder is unoccupied by the run of said web.

11. A drying section as claimed in claim 10, wherein said web is supported by a backing member and travels alternately around cylinders included in two different rows of cylinders whereby, at a cylinder included in the first row of cylinders, said web lies against the jacket of the cylinder while the backing member is on the outside and, at a cylinder included in the second row of cylinders, said web is on the outside while the backing member lies against the jacket of the cylinder, said suction means for delivering suction into the interior of a cylinder being connected to at least one of the cylinders included in said second row of cylinders.

12. A drying section as claimed in claim 1, wherein said substantially sealed space is limited in the longitudinal direction of the drying section by the run of said web arriving at said cylinder along the entire zone through which said web with its runs freely from a cylinder preceding said cylinder to said cylinder.

13. A drying section as claimed in claim 1, wherein said substantially sealed space is also limited in the longitudinal direction of the drying section by the run of said web departing from said cylinder along the entire zone through which said web runs freely from said cylinder to a next cylinder following said cylinder.

14. A drying section as claimed in claim 7, wherein said web is supported by a backing member travelling with said web in a meander-like fashion.

* * * * *

UNITED STATES PATENT AND TRADEMARK OFFICE

CERTIFICATE OF CORRECTION

PATENT NO. : 5,084,985

DATED : February 4, 1992

INVENTOR(S) : Jouko Ventola

It is certified that error appears in the above-identified patent and that said Letters Patent is hereby corrected as shown below:

Column 7, line 48, change "delivering said" to --being in flow communication with--.

Signed and Sealed this

Twenty-third Day of November, 1993

*Attest:*

Bruce Lehman

BRUCE LEHMAN

*Attesting Officer*

*Commissioner of Patents and Trademarks*